United States Patent [19]

Binder

[11] 4,216,634

[45] Aug. 12, 1980

[54] COMPOSITE BUILDING COLUMN

[76] Inventor: Burton A. Binder, 3093 Moon Lake Rd., West Bloomfield, Mich. 48033

[21] Appl. No.: 54,346

[22] Filed: Jul. 2, 1979

Related U.S. Application Data

[63] Continuation of Ser. No. 878,280, Feb. 16, 1978, abandoned, which is a continuation-in-part of Ser. No. 726,825, Sep. 27, 1976, abandoned.

[51] Int. Cl.[3] ..... E04C 1/00; E04H 12/00; E04C 3/30

[52] U.S. Cl. ..... 52/309.9; 52/301; 52/309.5; 52/309.7; 52/309.8; 52/727; 52/806; 264/46.6; 264/46.7

[58] Field of Search ..... 52/727, 724, 728, 301, 52/806, 309.9, 309.4, 309.7, 309.5, 309.8; 49/DIG. 1, DIG. 2; 248/539; 297/DIG. 1; 256/59, 65, 24, 21; 264/46.6, 46.7; 403/245, 264, 230, 187

[56] References Cited

U.S. PATENT DOCUMENTS

| | | | |
|---|---|---|---|
| 973,615 | 10/1910 | Barrick | 52/301 |
| 1,971,051 | 8/1934 | Reiner et al. | 52/301 |
| 2,099,470 | 11/1937 | Coddington | 52/301 X |
| 2,523,513 | 9/1950 | Oliver et al. | 256/59 |
| 3,233,871 | 2/1966 | Schroer | 256/69 |
| 3,291,437 | 12/1966 | Bowden et al. | 249/48 |
| 3,471,182 | 10/1969 | Schroer | 287/54 |
| 3,633,862 | 1/1972 | Breen | 248/251 |
| 3,915,434 | 10/1975 | Lister | 256/59 |
| 3,921,960 | 11/1975 | Bright | 256/65 |
| 3,968,561 | 7/1976 | Oakes et al. | 264/46.6 |
| 4,007,919 | 2/1977 | Totten | 256/59 |

FOREIGN PATENT DOCUMENTS

| | | | |
|---|---|---|---|
| 1658660 | 11/1970 | Fed. Rep. of Germany | 52/727 |
| 2137642 | 2/1973 | Fed. Rep. of Germany | 52/724 |
| 2450595 | 4/1975 | Fed. Rep. of Germany | 52/727 |
| 1223862 | 6/1960 | France | 403/264 |
| 842939 | 7/1960 | United Kingdom | 52/805 |
| 1264302 | 2/1972 | United Kingdom | 52/724 |

OTHER PUBLICATIONS

Alcoa 7.3/Al Sweet's Catalog, 1975, vol. 3, 8 pages.
Reynolds "Colonial Columns" Nov. 1974.

*Primary Examiner*—Leslie Braun
*Attorney, Agent, or Firm*—Cullen, Sloman, Cantor, Grauer, Scott & Rutherford

[57] ABSTRACT

A foam filled metal shell building column for dwellings and the like comprises one or more thin metal sheets formed as a hollow shell having a longitudinal load-bearing axis. The thin-walled hollow shell is filled with a core of a plastic foaming material including a suitable foaming agent which foams to fill the shell and to exert a force on the shell radially outwardly of the longitudinal axis thereby forming a solid composite column. The radially outward force deflects the shell and permanently places the shell in lateral tension to increase the load bearing capability of the column. When more than one sheet is used, the elongated edge portions of the sheets are configured to loosely interfit with one another when the shell is initially formed, and the plastic foaming material causes a positive locking of the interfitted edge portions. Thus thin, non-load bearing gauge aluminum is converted into a load bearing structural element.

5 Claims, 14 Drawing Figures

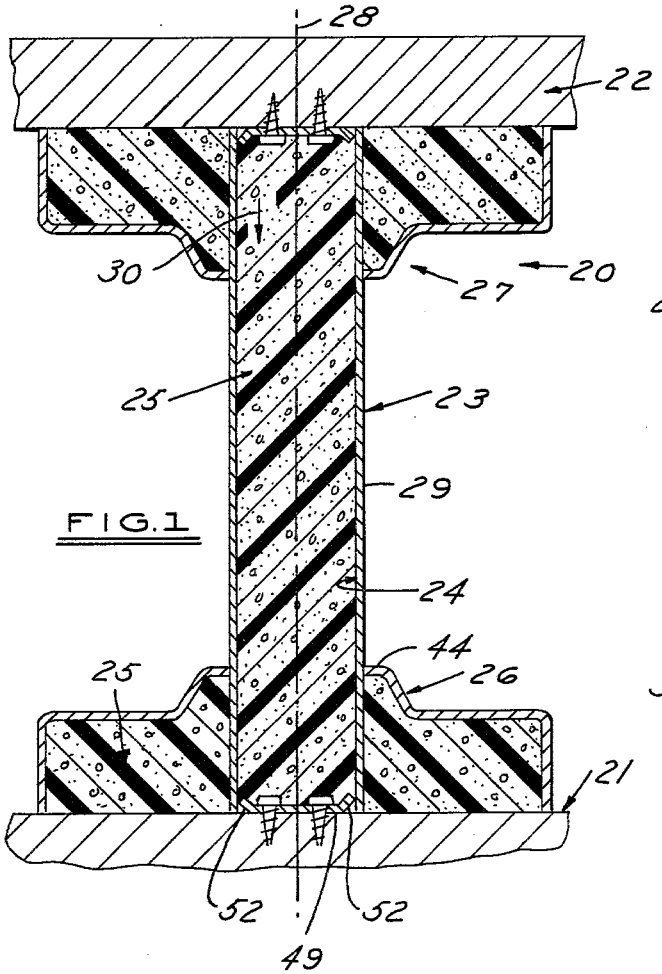
FIG. 1
FIG. 2
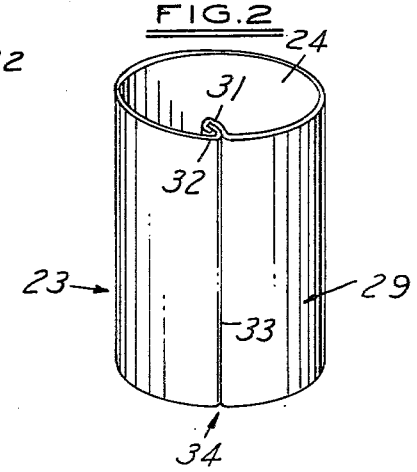
FIG. 3
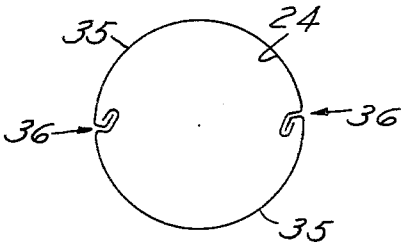
FIG. 4
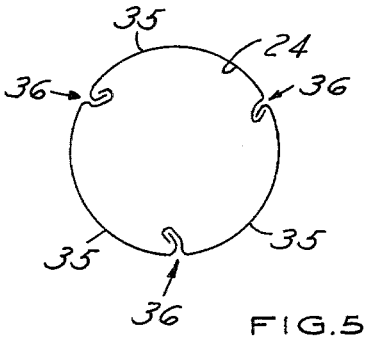
FIG. 5
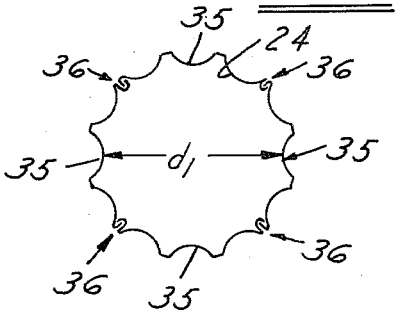
FIG. 6
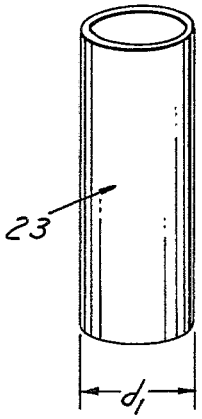
FIG. 7
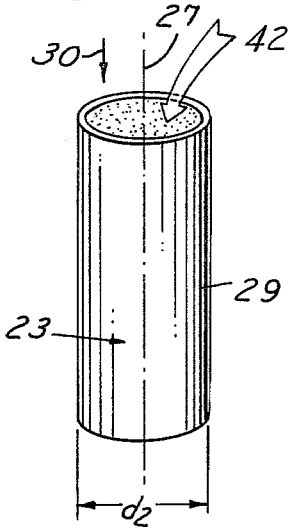

COMPOSITE BUILDING COLUMN

CROSS-REFERENCE TO RELATED APPLICATIONS

This is a continuation of application Ser. No. 878,280, filed Feb. 16, 1978 now abandoned, which is a continuation-in-part of application Ser. No. 726,825, filed Sept. 27, 1976, now abandoned.

BACKGROUND OF THE INVENTION

The present invention relates generally to composite building columns and, more particularly, to an improved low cost, light weight, composite building column which is both decorative and able to withstand substantial compression loads along its longitudinal axis.

Most of the building columns of the prior art are relatively heavy solid structures which serve both supportive and decorative functions. In order to be able to withstand compression loads such as may be encountered in supporting a porch or the like, the columns are generally made from solid wood, solid concrete, or some type of reinforced solid structure. These structures are expensive and difficult to make and they are hard to handle and erect due to their great weight.

Recently, a relatively lightweight decorative building column has been formed from extruded aluminum which can be formed into a hollow column having relatively thick side walls at least 0.060 inches thick which support the compression loads along the longitudinal axis of the column. While these columns represent a significant advance over the prior art, they are still expensive due to the amount of the aluminum required for the thick walls and due to the high cost of the extrusion process. The weight, although reduced, is still considerable rendering such columns difficult to transport, handle and erect. Workmen are required to assemble such columns at the job site. Such columns are not solid so they rattle and sound flimsy and hollow when struck.

While such attempts represent a significant advance over the prior art, the need still exists for a low cost, lightweight, decorative building column wherein the thickness of the material defining the column is greatly reduced so as to minimize the cost yet wherein the strength of the column and its ability to withstand compression loads along its longitudinal axis is increased or at least maintained without increasing the cost or weight of the column. A need continues to exist for a low cost, lightweight column which can be easily made, transported, handled and erected with a minimum of time and effort.

The building column of the present invention overcomes all of the disadvantages of the prior art set forth hereinabove and provides a lightweight, low cost decorative building column which is able to withstand compression loads along its longitudinal axis and which can be easily made, transported, handled and erected with a minimum of time and effort.

SUMMARY OF THE INVENTION

The foam-filled composite building column includes a shell of aluminum of a thin, non-load bearing gauge, the shell being filled with foam so that the filled aluminum shell becomes a load bearing, structural element.

More specifically, the building column of the present invention is able to withstand substantial compression loads along its longitudinal axis without buckling of the side walls. The column is formed by assembling a thin-walled hollow shell having a longitudinal axis and a cross-sectional configuration of a first dimension. The assembling of the hollow shell may include providing relatively thin sheets of lightweight material such as aluminum with edge portions configured to loosely interfit with one another when the shell is initially formed. The hollow shell is then filled with a plastic foaming material including a foaming agent and the plastic material foams to laterally expand the sides of the shell so that its cross-sectional configuration assumes a diameter slightly greater than the first dimension. This lateral or radially outward expansion deflects the shell and permanently places the shell in lateral tension to increase the load bearing capability of the shell and further causes the edge portions of the sheets to positively interlock along a longitudinal seam.

As the foaming material cures, it adheres to the inside walls of the shell and strengthens the laterally expanded shell so as to enable the composite column to withstand compression loads along the longitudinal axis without buckling the thin walls of the shell and without crushing or crumbling the foaming material. Non-adhering foam may also be used although foaming material which adheres as it cures is preferred.

The building column of the present invention includes one or more thin sheets of lightweight, non-load bearing material such as 0.019 inch thick aluminum of the type used in aluminum siding. Edge portions of the sheets may be configured so as to loosely interfit with one another, along longitudinal seams to form a thin-walled hollow shell having a longitudinal axis. Preferably the sheets are of longitudinal fluted or doric configuration. The sheets, including the edge portions and the fluted formations, can be made by roll forming.

Plastic forming means is disposed within the hollow shell for laterally expanding the shell outwardly, to place the shell in outward lateral tension and to permanently interlock the edge portions along the longitudinal seams. Thus the composite column is a load bearing structural element.

The thin sheets may be some type of lightweight material such as aluminum or the like having good weatherability properties and, in the preferred embodiment of the present invention, the walls are substantially thinner than 0.060 inches thereby greatly reducing the amount of material required to form the column and the cost and weight thereof. A single sheet may be shaped or rolled to form the column with one edge portion being configured to loosely interfit with the opposite edge portion so as to form a permanent longitudinal seam after expansion. Alternatively two, three, four or more thin, sheet-like segments may be formed with edge configurations adapted to be loosely interfitted together to form the desired columnular shape. The interfitting edge portions are preferably self-locking upon lateral expansion of the column and generally determine the normal outer limit of lateral expansion.

Additionally, the present invention provides a socket-like base portion or top portion adapted to be fitted around the end or ends of the column. In a preferred embodiment, the socket-like portion is formed in the desired hollow configuration from a single sheet of lightweight material such as aluminum and an aperture is punched therethrough to allow for the insertion of the end portion of the column. The punched out section of the sheet is generally in the form of a dish-shaped disk and may be secured to the ground plane or roof so as to retainably receive the end of the column thereover in a force fit or friction fit manner. The column is therefore retainably secured to the roof or ground plane in a relatively simple manner while the socket-type portion frictionally engages a portion of the inserted end of the column about the aperture. The hollow interior of the socket-like portion may be filled with foaming material which expands and cures to strengthen the socket-like portion by placing the same in outward lateral tension and even more securely support the column itself.

Finally, an elongated reinforcing element may be inserted within the hollow interior of the column and aligned parallel to the longitudinal axis. When the column is subsequently filled with plastic foaming material, the curing foam will also adhere to the support and place the same in compression for further strengthening the column and increasing its load-bearing capacity. This is particularly useful when the exterior surface of the thin walls of the column is shaped to present a decorative exterior design which is less able to withstand compression loads.

BRIEF DESCRIPTION OF THE DRAWINGS

The various objects and advantages of the present invention will be more fully understood upon reading the following detailed description of the invention taken in conjunction with the drawings. In the drawings, wherein like reference numerals identify corresponding components:

FIG. 1 is a fragmentary, front sectional view of a foam-filled thin metal shell forming a building column of the present invention positioned for illustrative purposes between a porch roof and a ground plane surface;

FIG. 2 is a fragmentary, perspective view of a thin-walled hollow shell formed from a single sheet of relatively thin lightweight material having one edge portion secured to another along a longitudinal seam;

FIG. 3 is a top plan view of another embodiment of the thin-walled-hollow shell of FIG. 2 wherein two thin metal sheets are adapted to be loosely interfitted together to form the desired configuration of the shell;

FIG. 4 is a top plan view of another embodiment of the present invention wherein three thin metal sheets are utilized to form the shell for the column of the present invention;

FIG. 5 is a top plan view of a preferred embodiment of the thin-walled hollow column of FIG. 2 wherein each of the thin metal sheets are of fluted design;

FIG. 6 is a perspective view representing the shell prior to the introduction of the core;

FIG. 7 is a perspective view representing the thin-walled shell after it is filled with the plastic foaming material including the foaming agent;

DESCRIPTION OF THE PREFERRED EMBODIMENT

Figure 8:
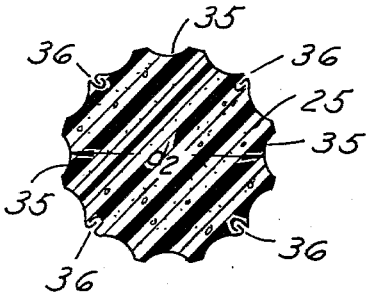
FIG. 8 is a sectional view looking in the direction of the longitudinal axis of a thin-walled fluted shell of FIG. 5 which has been filled with a plastic foaming material and allowed to expand laterally to put the thin walls in lateral tension.

FIG. 1 shows the building column assembly 20 of the present invention as it is operatively positioned between a relatively flat ground plane or support surface 21 and a porch-like roof or overhang 22. The building column assembly 20 includes a thin-walled hollow shell 23 which has its hollow interior 24 filled with a core such as a plastic foaming material 25. The term plastic foaming material as it is used herein, includes both the plastic foam, or foaming material itself and the foaming agent required to bring about the foaming action, and any suitable, conventionally known foaming material may be used. The column assembly 20 may further include a substantially hollow, thin-walled, socket-type assembly or base portion 26 and a corresponding substantially hollow, thin-walled, upper socket-type assembly 27. The column assembly 20 disclosed in FIG. 1 has a generally cylindrical cross-sectional configuration and a substantially vertical longitudinal axis 28.

As illustrated in FIGS. 1 and 2, the walls 29 of the thin-walled hollow shell 23 are relatively thin and the interior portion 24 of the shell 23 is hollow, as indicated in FIG. 2, prior to its being filled with the plastic foaming material 25. FIG. 2 shows a thin-walled hollow shell 23 which is formed from a single sheet of lightweight material such as aluminum or the like having good weatherability. Preferably thin gauge aluminum, of the thickness used in aluminum siding, (e.g. around 0.019 inch) is preferred. A first edge portion 31 of the sheet or wall portion 29 is shaped or configured so as to loosely interfit with a second correspondingly configured edge portion 32 so as to form a generally continuous shell 23 having a substantially cylindrical columnular configuration. The edge portions 31, 32 may be retainably secured to one another via brazing or some conventionally known fastening means 33 along a longitudinal seam 34 either before or after expansion but, in the preferred embodiment disclosed herein, the lateral expansion of the shell will cause the edge portions 31, 32 to automatically interlock with one another to form a continuous, permanent, watertight longitudinal seam 34 which does not require fastening means or brazing or crimping.

FIGS. 3, 4 represent alternate embodiments of the generally cylindrical thin-walled hollow shell 23 of FIG. 2, with two and three relatively thin sheet-like segments 35, respectively, each having end portions 36 which are adapted to be loosely interfitted to one another to form the generally cylindrical, thin-walled, hollow shell 23 of FIG. 2.

FIG. 5 illustrates a preferred construction wherein the external surface of the walls of the shell 23 contain a plurality of longitudinally aligned fluted formations.

From the above description of FIGS. 2, 3, 4 and 5, it will be obvious that any number of segments 35 may be employed to achieve the desired configuration of shell 23 and that any suitable type of fastening means and/or configuration of end portions 36 can be used in light of these teachings. Regardless of which of the methods are used to assemble the thin-walled, hollow shell 23 an regardless of the desired cross-sectional configuration, the shell 23 can be filled with a plastic foaming material 25 which expands laterally in a direction generally perpendicular to and radially outwardly from the longitudinal axis 28 so as to slightly expand the cross-sectional dimension or configuration of the shell 23 and permanently place the shell in lateral tension. This expansion also causes the loosely interfitting edge portions 36 to permanently interlock along longitudinal seams 34 and the curing of the foaming material 25 causes it to positively adhere to the interior of the walls 29 or the segments 35 and rigidify so as to strengthen the shell 23 and allow it to sustain compression loads, represented by the arrow 30 in FIG. 1, in a direction along the longitudinal axis 28 without buckling the thin outer walls 29.

The method of making the column of the present invention will be described with reference to FIGS. 2 through 9. FIGS. 2-6 represent the step of assembling the thin-walled hollow shell 23 having a longitudinal axis 28 and a cross-sectional dimension "$d_1$" from a relatively thin sheet of lightweight material such as aluminum or the like. These figures also represent the step of forming the edge portions 31, 32 of the sheet 28 or the edge portions 36 of the segments 35 into predetermined configurations adapted to allow the end portions to be loosely interfitted to one another for forming the hollow shell 23 in the desired column configuration.

Optionally the hollow shell 23 may be enclosed within an elongated hollow forming structure or form which has a similar cross-sectional configuration and an inside configuration or diameter "$d_2$" which is slightly greater than the initial diameter "$d_1$" of the hollow shell 23. The elongated hollow form completely encircles the hollow shell 23 and the form may be secured in the closed position by conventional fastening means.

FIG. 7 represents the step of filling the hollow shell 23 with the foaming material 25. If a form is used, there must be a slight air space immediately surrounding the hollow shell 23 to allow for lateral expansion. The outer limit of lateral expansion is determined, of course, by the interior surface of the form so as to positively limit the lateral expansion to the maximum internal diameter "$d_2$" of the closed form. If a form is used, the bottom of the hollow shell 23 is closed by the base portion of the form and the plastic foaming material 25 is fed or introduced into the hollow shell 23 as indicated by the arrow designated 42.

In a preferred embodiment urethane having a density in the range of 1.5 to 2.0 pounds per cubic foot is used as the core or foaming material 25. Sufficient foam should be used, based on the length of the column so that the lateral expansion is in the range of $\frac{1}{4}''$ to $\frac{1}{2}''$ for a 12 inch diameter column. Thus $d_2$ should exceed $d_1$ by about 2 to 4 percent. This provides the necessary lateral outward tension on the shell for the desired strength without rupturing the shell.

Figure 9:
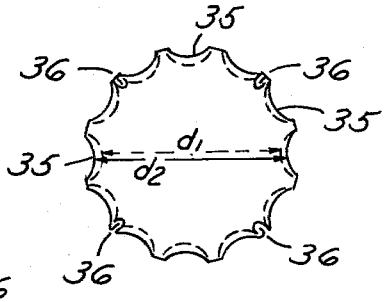
FIG. 9 is a diagrammatic illustration of the fluted thin-wall shell illustrating in solid lines the lateral expanded configuration and in dotted lines the initial configuration of the shell.

The introduction of the plastic foaming material 25 which is represented by the arrow 42 contemplates either the simultaneous introduction of both the plastic foaming material and a suitable foaming agent or separate introduction, as desired. Once the appropriate materials are introduced or activated, the plastic foaming material 25 will expand laterally outward in a direction generally normal to the longitudinal axis 28 until the cross-sectional dimension of the shell 23 has been expanded from the initial dimension "$d_1$" to the slightly greater dimension "$d_2$" as indicated in FIGS. 7, 8 and 9. The top portion of the shell 23 may be closed by a top or cap once the plastic foaming material 25 has been introduced, which cap can be provided with conventionally known safety valve means, not shown, if such were required. As an alternate, the expanded dimension "$d_2$" may be attained without the use of the hollow form if strict accuracy of the dimension "$d_2$" is not required.

After a predetermined amount of expansion and curing of the plastic foaming material 25 has taken place, the composite foam-filled, dimensionally-expanded, edge-interlocked, rigidified column of FIG. 8, with the shell in outward lateral tension, is able to withstand compression loads along the longitudinal axis 28 without the thin walls 29 buckling due to the lateral expansion of both the plastic foaming material 25 and the shell being in tension. The expanded and cured foaming material 25 adheres permanently to the interior walls of the sides 29 and hardens to reinforce shell 23 to increase its load-bearing capability with a minimal thickness of sheet-like material thereby minimizing the cost while insuring an extremely lightweight column which is easy to manufacture, easy to transport, easy to handle, and easy to install by a minimum of workmen.

As previously explained, the preferred embodiment of the present invention contemplates the use of a shell which is longitudinally fluted, whether it be made as a single sheet or a plurality of sheets. This preferred configuration of the shell is illustrated in FIG. 5 where the shell, as formed, has an internal diameter (between opposed fluted portions) identified as "$d_1$". When a fluted shell of this configuration is filled with the foam core 25, whether or not a form is utilized, the completed column is illustrated in cross-section in FIG. 8.

As heretofore explained, the lateral expansion of the foam core 25 causes a lateral expansion of the fluted walls of the shell and places these walls in lateral outward tension. Thus the diameter between opposed fluted portions has been increased to a dimension "$d_2$" which is greater than "$d_1$". The relationship of this expansion and permanent tension is illustrated diagrammically in FIG. 9 wherein the initial configuration of the shell and its initial diameter are illustrated in dotted lines and whereas the final configuration of the shell is illustrated in solid lines with a diameter "$d_2$". For the purpose of clarity of illustration, the foam core 25 has been eliminated from FIG. 9.

Once the column has been completely formed, it may be cut to the desired length with a conventional carpenter saw. Thereafter, it may be installed between a ground plane 21 and an upper overhang 22 as illustrated generally in FIG. 1. The details of such an installation do not form a part of the method of the instant invention but are hereafter described for the sake of completeness.

Figure 10:
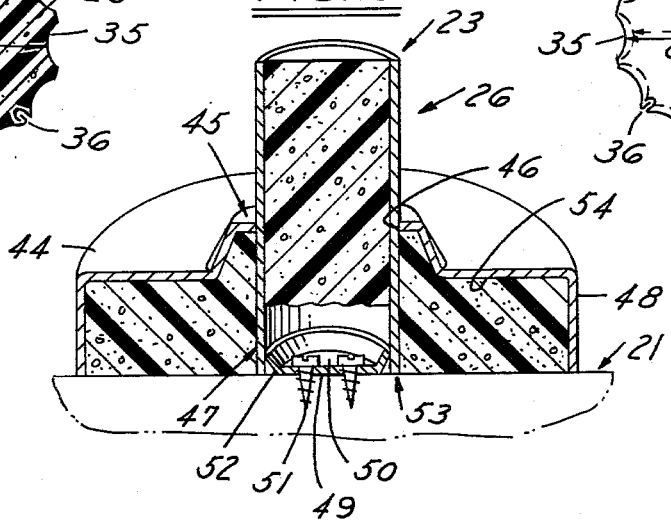
FIG. 10 is a fragmentary perspective view, partially in section, of the foam-filled building column of the present invention including a relatively thin-walled base structure or socket-like assembly.

FIG. 10 shows a lower end portion of a foam-filled column 23 having a socket-type portion or base assembly 26 associated therewith. The base assembly 26 is formed, in the preferred embodiment of the present invention from a single sheet of relatively thin light-weight material such as aluminum or the like. The base assembly 26 has an upper surface 44 which is generally annular so as to surround a punched out central aperture 45. The aperture 45 is defined by a circular edge portion 46 adapted to retainably engage a portion of the lower end 47 of the column 23 in a friction-type or force-fit manner for securing the base assembly 26 to the column 23. A side portion 48 extends vertically downward from the upper surface 44 although any decorative configuration of the upper surface 44 and the side portion 48 can be used.

The thin circular portion of sheet metal 49 which was punched out when the aperture 45 was formed in the base assembly 26 has a generally dishshaped configuration. The central portion 50 of the dish-shaped disk 49 may be rigidly anchored to the ground plane 21 by screws 51 or some other conventionally known fastening or anchoring means. The central portion 50 of the dish-shaped member 49 is precisely located on the ground plane 21 so that the lower end portion 47 of the column 23 may be received thereover. The edges or rim portions 52 of the dish-shaped member 49 are frictionally received within the interior of the end 47 of the column 23 so as to frictionally engage and receivably retain the column 23 with respect to the ground plane 21. With this arrangement, the column 23 and the base assembly 26 are to be, in the preferred embodiment disclosed herein, secured solely by friction fit means. The column 23 is retainably positioned with respect to the ground plane 23 by means of the dish-shaped member 49 while the base assembly 26 is secured about the lower end 47 of the column 23 via the edge portions 46 of the aperture 45 in the upper surface 44 of the base assembly 26. Alternatively, set screws or some other conventional fastening means 56 can be used to secure the column 23 to the base assembly 26.

In the preferred embodiment, the socket-type base assembly 26 is formed at the factory where it is prefoamed with a hollow central passage therethrough. The configuration of the passage is adapted to receive the prefoamed column 23 therein. The pre-foamed base assemblies 26 and the prefoamed columns 23 are shipped loose to the job site where the base assembly 26 is slid over the column 23 far enough to permit installation. It is then properly positioned on the ground plane 21 and then secured thereto by friction means 49 or set screws or the like.

Alternately, a non-foamed hollow base assembly 26 may be placed in the proper position with respect to the ground plane 21 prior to the insertion of the lower end 47 of the column 23 through the aperture 45. The lower end 47 of the column 23 is then inserted through the aperture 45 until its distal end 53 supportedly abutts the ground plane or surface 21. The hollow interior portion 54 within the base assembly 26 may then be filled with the plastic foaming material 25 previously described. The plastic foaming material 25 expands to fill the hollow interior 54 and when it cures, it may adhere to the interior surfaces of the base portion 26, the ground plane 21, and the exterior surface of the lower portion 47 of the column 23 so as to further secure the column 23 and base 26 with respect to the ground plane 21 and to further strengthen same.

Whether pre-foamed or filled with foam at the installation site, the foam places the socket walls in outward lateral tension for increased strength.

Figure 11:
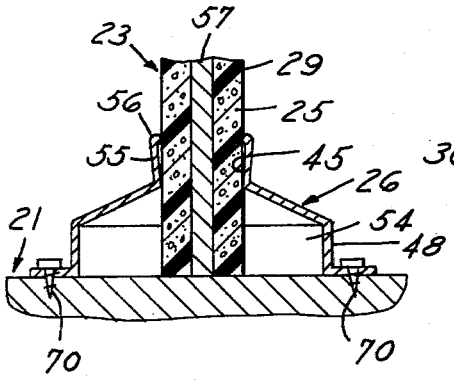
FIG. 11 is a fragmentary sectional view of the building column of the present invention including both a thin-walled, socket-like portion and an elongated reinforcing element disposed within the interior of the column.

FIG. 11 shows still another embodiment of the base assembly 26 and column 23 of the building column assembly 20 wherein the hollow interior 54 of the base portion 25 is not or has not yet been filled with the plastic foaming material 25. in the preferred embodiment of the present invention the plastic foaming material 25 would be used to fill the interior 54 but this may not always be required. Similarly, it may be desirable to provide the upper surface 44 of the base assembly 26 with an annular collar portion 55 for defining the aperture 45 and receiving the lower end 47 of the column 23 instead of or in addition to the friction fit between the base assembly 26 and the column 23. Any conventional fastening means 56 such as set screws, brazing or the like may be used. Similarly set screws or any conventional fastening means 70 may be used to secure the base assembly 26 to the ground plane 21.

Figure 13:
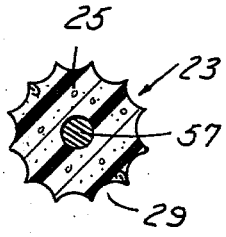
FIG. 13 is a top plan view looking in the direction of the longitudinal axis of a thin-walled hollow column having a fluted doric design about the exterior surface thereof.

FIGS. 11 and 13 show an elongated relatively rigid reinforcing element 57 such as a steel rod or the like inserted centrally into the interior 24 of the thin-walled hollow column 23 prior to its having been filled with plastic foaming material 25 so that the element 57 is parallel to and generally coincident with the longitudinal axis 28. When the hollow interior portion 24 is filled with the plastic foaming material 25 and it expands laterally outwardly and curves, it adheres to both the inside surfaces of the walls 28 and the exterior surfaces of the reinforcing rod 57 so as to further strengthen the column 23 and increase its compression load-bearing capability. Alternatively, a hollow central core or passage may be left or formed in the foaming step so as to save foaming material 25 and provide for the easy installation of structural reinforcing elements 57 if required. This structure would also provide a passage for electrical wires, waster lines or the like if desired.

Figure 12:
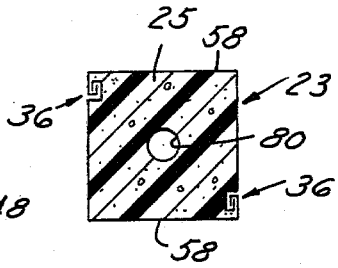
FIG. 12 is a top plan view looking in the direction of the longitudinal axis of an embodiment of the column of the present invention having a generally rectangular cross-sectional configuration.

FIG. 12 shows a top plan view of an alternative embodiment of the thin-walled hollow column 23 in which two L-shaped members 58 are secured together as by fastening means 36 so as to form a generally rectangular cross-sectional column configuration including a hollow central passage 80 for a reinforcing element. With any of the column configurations of this invention, any number of wall segments may be used. The fastening means 36 may be, some conventionally known type of loosely interfitting configuration which is able to automatically lock upon lateral expansion of the column walls and the walls being placed in lateral tension. It will be generally recognized that any shape of cross-sectional configuration is possible in the present invention although a circular cross-section possesses the maximum load-bearing capability.

It will be recognized that the exterior surface of any of the columns 23 of the present invention may contain any type of design configuration. Since the design configuration may tend to lessen the compression load-bearing capability of the columns 23, such exterior design features are particularly useful in combination with columns 23 employing the support elements 57 of FIG. 11 which increase the load-bearing capability of the column 23 although such elements 57 are not usually necessary.

Figure 14:
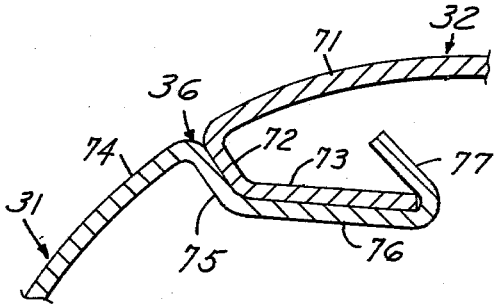
FIG. 14 is a top plan view of a blown-up portion of the column of FIG. 5 showing the preferred embodiment of the interlocking edge portion configurations of the segments which form the column of the present invention.

FIG. 14 shows an enlarged view of the interlocking edge configurations 36 used to connect the sheet-like segments or wall sections 35 together to form the shell 23 of the present invention. The outer edge portion 32 includes a first portion 71 which serves as a portion of the outer wall 29 of the shell 23, a second, inwardly angled portion 72 which forms an acute angle with the first portion 71, and a third relatively straight portion 73 which forms an obtuse angle with the second portion 72 so that the first, second and third portions 71, 72, and 73, respectively, form a generally U-shaped, inwardly-turned lip. The inner edge portion 31 includes a first portion 74 which serves as a portion of the outer wall 29 of the shell 23 and a second inwardly angled portion 75 adapted to be disposed flush against the portion 72 and which forms an acute angle with the first portion 74. The edge portion 31 further includes a third relatively straight portion 76 which forms an obtuse angle with the portion 75 and which is adapted to be disposed flush against the corresponding third portion 73 of the outer edge portion 32. Lastly, the inner edge portion includes a fourth portion 77 which forms an acute angle with said third portion 76 and which is disposed outwardly therefrom so that the portions 75, 76, 77 form a hook for operatively engaging the lip in a loosely interfitting manner. Upon lateral expansion of the walls 29 of the shell 23, the edge portions 31, 32 (generally designated 36) will self-lock to form the desired columnular configuration. The fluted portions of the sheets, as well as the edge configurations, may be produced by a roll forming operating.

THE SYNERGISTIC RESULTS

Several synergistic results are obtained from the present method.

First, the load-bearing capacity of the column exceeds the sum of the individual load-bearing capacities of the shell and of the core. It is believed that this is a result of placing the skin in a permanent laterally outward tension. It should be noted that thin aluminum siding is thus made into a load-bearing structural element.

Second, it is possible to cut the finished column to a precise length at the time that the column is installed to support a porch or the like, by using a conventional carpenter's saw.

Third, when the column is to be positioned against a wall, a conventional rip saw may be used to longitudinally cut the column in half. The half-column may be placed flat against the wall and secured thereto either by fasteners or glue.

Fourth, the column, when struck laterally with a hammer or the like, sounds like a solid wood column--it does not sound like thin metal nor does it sound as though there is a foam core.

Fifth, the skin may be painted before roll forming, filling and cutting. The paint is not damaged by the subsequent operations nor does the paint chip or crack from the lateral expansion of the skin being placed in tension.

TEST RESULTS

To properly evaluate benefits of the present method, various tests have been made utilizing columns having a round cross-section. The columns are made having a shell of non-load-bearing aluminum having a thickness of 0.019 inches with a core material of foamed urethane. In each instance the diameter of the column was twelve inches. The shells were initially painted with a vinyl paint having a reflectivity in the range of 65%–80% and compatible with urethane.

The first two columns had a sixteen foot length and each column supported over 7000 pounds. The second two columns had an eight foot length with the first of such columns supporting 5500 pounds and the second of such columns supporting 8000 pounds. At these loads the paint did not appear to crack or chip.

In the preferred embodiment disclosed herein, the plastic core generally designated by the reference numeral 25 is a low density rigid urethane such as styrofoam or any expanding cellular high porosity plastic material. It will be recognized that a suitable core materials may be used providing that the foaming material produces the desired lateral expansion to place the shell in lateral tension. Heat may be added to initiate or sustain the foaming reaction and/or to facilitate curing.

With this detailed description of the present method, it will be obvious to those of ordinary skill in the art that other modifications can be made without departing from the spirit and scope of the present invention.

What is claimed is:

1. A decorative building column for use with houses and the like to withstand substantial compression loads along the longitudinal axis of the column without buckling comprising:

a thin-walled hollow non-load-bearing shell having a longitudinal axis and a cross-sectional configuration of a first dimension formed of at least one sheet-like means of relatively thin lightweight metal such that the edge portions of said sheet-like means loosely interfit with one another to form said thin-walled hollow column;

a plastic foaming means disposed in the interior of said shell for laterally expanding against the thin wall for laterally expanding said cross-sectional configuration of said thin-walled hollow shell to a second dimension slightly greater than said first dimension for placing said shell in laterally outward tension, the lateral expanding of said plastic automatically positively locks the edge portions of said sheet-like means along a longitudinal seam and the expanding plastic adheres to the interior walls of said shell, said second dimension exceeds said first dimension by about two to four percent;

a substantially hollow, socket-type portion having a central aperture therein adapted to retainably receive one end of said building column therethrough, said socket-type portion shaped so as to have a top surface portion and side walls integral therewith and extending therefrom so as to form a generally hollow central portion, said central aperture dimensioned to corespond to the cross-sectional configuration of the end portion of said building column adapted to be received therethrough, said socket-type portion further includes a substantially dish-shaped disk of relatively thin lightweight metal, a rim portion of said dish-shaped disk being adapted to be received within the end portion of said building column which is received within said socket-type portion, anchoring means adapted to retainably secure the dish-shaped disk in a predetermined position on a support surface for retainably securing said building column in a predetermined position on said support surface, and additional plastic foaming means disposed within said hollow interior of said socket-type portion for forming a passage for receiving the inserted end portion of said column therethrough and strengthening said socket-type portion, said additional foaming means placing said socket-type portion in lateral outward tension and said additional foaming means adhering to the interior surfaces of said socket-type portion and the exterior surface of the inserted end portion of said column so as to further secure the column;

whereby said column including the shell and the foamable plastic withstand compression loads along said longitudinal axis without buckling said shell and without crumbling said plastic.

2. In the invention as defined in claim 1 wherein the sheets are painted prior to forming the shell;

whereby said paint is not marred, chipped or cracked by the lateral expansion of said shell or the placing of said shell in lateral outward tension.

3. The invention as defined in claim 1 wherein said shell includes at least three sheets loosely interfitted together.

4. The invention as defined in claim 1 wherein said shell includes at least two elongated fluted members interfitted together.

5. The building column of claim 1 wherein said sheet-like means includes a single relatively thin sheet of light-weight metal adapted to be rolled to form said thin-walled column.

* * * * *